US005372736A

United States Patent [19]

Trivett

[11] Patent Number: 5,372,736

[45] Date of Patent: Dec. 13, 1994

[54] SYNTHETIC HOT MILL LUBRICANT FOR HIGH TEMPERATURE APPLICATIONS

[75] Inventor: Robert L. Trivett, Aurora, Ill.

[73] Assignee: Nalco Chemical Company, Naperville, Ill.

[21] Appl. No.: 141,768

[22] Filed: Oct. 27, 1993

[51] Int. Cl.[5] ..... C10M 129/95

[52] U.S. Cl. ..... 252/56 R; 252/56 S

[58] Field of Search ..... 252/56 R, 56 S, 49.5

[56] References Cited

U.S. PATENT DOCUMENTS

| | | | |
|---|---|---|---|
| 3,223,635 | 12/1965 | Dwyer et al. | 252/51.5 |
| 3,257,835 | 6/1966 | Cofer et al. . | |
| 3,296,682 | 1/1967 | Cofer et al. . | |
| 3,317,994 | 5/1967 | Cofer et al. . | |
| 3,517,537 | 6/1970 | Cofer . | |
| 3,672,199 | 6/1972 | West et al. . | |
| 3,766,763 | 10/1973 | Cofer et al. . | |
| 3,881,336 | 5/1975 | Cofer et al. . | |
| 3,881,337 | 5/1975 | Cofer et al. . | |
| 4,087,890 | 5/1978 | Linne . | |
| 4,106,319 | 8/1978 | Linne . | |
| 4,159,633 | 7/1979 | Linne . | |
| 4,193,823 | 3/1980 | Linne . | |
| 4,260,502 | 4/1981 | Slanker | 252/49.5 |
| 4,578,202 | 3/1986 | Urban et al. | 252/33.4 |
| 4,632,770 | 12/1986 | Slanker | 252/49.5 |
| 4,790,957 | 12/1988 | Mach et al. | 252/56 S |
| 4,885,104 | 12/1989 | Sturwold | 252/48.4 |

*Primary Examiner*—Prince Willis, Jr.
*Assistant Examiner*—Cephia D. Toomer
*Attorney, Agent, or Firm*—Robert A. Miller; Joseph B. Barrett; James J. Drake

[57] ABSTRACT

The present invention contemplates a hot mill lubricant composition capable of use in demanding hot steel rolling mill operations wherein the composition comprises a synthetic base carrier composition comprising a mixture of dimeric and polymeric esters formed between saturated and unsaturated fatty acids with up to 18 carbon atoms, and various alcohols and polyols, said composition having a molecular weight between 500 and 1000 daltons (da). In addition to providing superior lubrication compatible with mill operations at elevated temperatures, the composition of the present invention provides additional advantages such as superior breakout and plateout characteristics.

2 Claims, No Drawings

SYNTHETIC HOT MILL LUBRICANT FOR HIGH TEMPERATURE APPLICATIONS

FIELD OF THE INVENTION

The present invention is generally related to compositions for lubricating metal. In particular, the present invention relates to synthetic lubricant compositions comprising, as a major component, a base carrier comprising a mixture of dimeric and polymeric esters formed between saturated and unsaturated fatty acids with up to 18 carbon atoms, and various alcohols and polyols, wherein the lubricating compositions is capable of use in hot rolling steel mill processes characterized by high operating temperatures.

BACKGROUND OF THE INVENTION

Rolling mills for hot-rolling metal are well known in the art. Examples are shown in U.S. Pat. Nos. 3,257,835, 3,317,994, 3,296,682, 3,517,537, 3,672,199, 3,766,763, 3,881,336, 3,881,337, 4,087,898, 4,106,319, 4,159,633 and 4,193,823, the teachings of which are herein incorporated by reference. Such rolling mills normally roll metal stock, such as bar or rod, between pairs of smooth finished work rolls, or bearings, in roll stands or reduce the gauge of steel prior to processing into other types of ferrous substrates.

Industries dependent upon robing mills as a step in a manufacturing process, as e.g., the steel and aluminum industries, have been constantly searching for means to reduce the wear on the rolls. Reduced wear on the rolls results in increased roll life, thus fewer roll changes are required which, in turn, results in an increase in mill production, measurable in terms of the number of units manufactured between roll bearing changes. In additions, savings are realized from fewer roll redressings and reduced roll inventor requirements.

The main source of roll wear is friction. As metal stock enters a series of work rolls in a rolling mill, the final gauge or thickness of the rolled work material is dependent upon several factors. These will include the type of work material itself, surface characteristic of the work material, temperature of the work material, line speed of the work material, the number and configuration of work rolls, size of the rolls and cooling capabilities of the like. As metal stock enters a deforming and/or shaping region, the stock is progressively bent by a series of rollers until it assumes a desired shape such as a tube of circular cross section. It will be readily apparent to one of skill in the relevant art that other rolled steel products may be produced by rolling mills, including rectangular cross-section tube, "C" and "U" shaped steel channels, and other complex cross-sectional shapes.

When surfaces of work rolls and metal stock are placed in contact, they do not usually touch over the whole of their apparent area of contact. In general, they are supported by surface irregularities which are present even on the most carefully prepared surfaces. Even small loads produce plastic flow of the irregularities at these regions of contact, and the asperities crush down until they are large enough to support the load. Metallic junctions are often temporarily formed at the regions of real contact by a process of welding, and these junctions formed between the mill rolls and stock are subsequently sheared by the relative motion of rolling. The immediate consequence of this welding and shearing action, as it applied to hot rolling of stock, is that work roll surfaces are worn by the progressive removal of work roll surface material, stock quality is diminished as ferrous material becomes imbedded beneath the work surface, the working life of work rolls is reduced as stock materials becomes adherent to the surface of the rolls, and geometry of the rolling pass is distorted.

Lubrication of the surface of the rolls has been found to be most effective for resisting or minimizing the effects of the abrasive processes generally described above. Typically, the deforming and/or shaping rolls are continuously sprayed with a coolant/lubricant which serves to lubricate the rolls, and to remove at least some of the surface deposits formed during the milling process.

Many benefits from the use of hot mill rolling lubricants accrue, in addition to increased production at lower costs, such as minimizing metal pickup from the workpiece and peeling or removal of metal from the roll bearings to the workpiece as it goes through the various stands of the rolling operation. Proper lubrication during the hot rolling metal also gives an improved product surface quality due to the improved surface condition of the work rolls.

The introduction of suitable lubricants to effect a separation of the contacting surfaces between rolls and work material is important to reduce the effects of welding-shearing of loaded and load carrying surfaces in terms of usable roll life and work material quality. Lubricant suppliers have attempted to capitalize on the abilities of certain organic materials to become inherently attached to the surfaces of the rolls by chemical actions of polar activity. Typical materials of this type are natural oils such as palm and rapeseed oils. Although possessing some value as lubricants, these oils are typically present as a carrier base. These natural oils and their synthetic counterparts are expensive, and their lubricity performance will usually deteriorate with the increased temperatures typical of hot rolling. More inexpensive lubricants for hot rolling applications are based on nonpolar petroleum mineral oils in conjunction with emulsifiers, which together provide only minimal lubrication because their synthetically induced wetting and attraction to the conventional roll surfaces is soon lost due to contamination and the effects of high temperature exposure. The arrangement and position of lubricant sprays relating to the roll surfaces is not always remedial in compensating for the inability of such lubricants to be attracted to and carried on the surface of the rolls.

In rolling mill lubrication processes, the amount of lubricant which is processed, i.e., misted, is referred to as "throughput." Throughput is expressed as a unit of weight or volume per unit of time, e.g., grams/hour, and is further broken down into the following three components: (a) dropout, or breakout, (b) reclassified oil, and (c) stray mist. Dropout is the amount of mist which is condensed in the lines and never reaches the reclassifier. Mist which is condensed in the distribution lines may be returned to the mist generator and remisted. Reclassified oil is the actual amount of lubricant which is applied to the surface being lubricated. Mist which is not applied to the surface being lubricated but rather escapes into the atmosphere is referred to as stray mist or stray fog. Since throughput is equal to (a)+(b)+(c), stray mist is obtained by determining the difference between the throughput and the sum of (a) and (b). Dropout, reclassified oil, and stray mist are often reported as a percent of throughput or can be represented as a ratio.

Many types of lubricants have been developed for lubricating the surfaces of the work rolls in a hot rolling mill to reduce roll wear due to friction. The lubricants can be combined with water to form a coolant-lubricant system which cools the hot work material while lubricating the surfaces of the work rolls. These lubricants are conveniently divided into two major groups: (1) those which form heterogeneous aqueous mixtures, i.e., more than one phase; and (2) those which form homogeneous aqueous solutions or apparent solutions, i.e., one phase.

Lubricants of group (1) are normally thought to have relatively low lubricity and relatively low wetting ability. They also are nonpolar and thus must be synthetically suspended in water (which is polar) by emulsifying or dispersing agents. Group (1) lubricants are therefore normally referred to in the art as oil-in-water emulsion lubricants.

Oil-in-water emulsion lubricants form a suspension of lubricant material in water, are often milky white in color, and are opaque. The lubricant base is normally refined mineral oil to which are added an emulsifier agent and detergent, so that the lubricant will form tiny, suspended droplets of various diameters when mixed with or added to water. Since emulsion lubricants are the least expensive, conventional oil-in-water emulsion systems have long been attractive from a cost standpoint and are generally preferred in high volume, high make-up systems. When used for cooling lubrication in mild to medium duty applications, oil-in-water lubricants are usually found to be an acceptable choice. In extreme pressure, or high temperature service such as hot rolling, however, satisfactory lubrication and extended roll life are compromised because the typical oil-in-water lubricant is subject to failure.

As previously mentioned, this type lubricant mixture is comprised of minute droplets of non-uniform size and held in water suspension by the action of emulsifier or dispersing agents. The ability to lubricate metal surfaces by the usual means thereby becomes dependent on sufficient numbers of these lubricant droplets transferring from the water carrier medium and attaching themselves to all parts to be lubricated or, more specifically, the smooth finished work roll surfaces. Furthermore, it has been established that this ability to "plate out" or wet smooth finished metal surfaces is not shared by all lubricant droplets but is characteristic of only a few whose physical size fall within a relatively narrow range of diameters. In general, of the total lubricant content expressed as per cent volume of the working emulsion, only a very small amount is actually beneficial in reducing roll wear. High temperature, dissolved metal ions, hard water ions, gear box lube contamination, mechanical shear forces, and improper pH control are all forces which act to segregate the size of droplets to levels outside the range which is known to be useful. Considering the above description of lubricant dispersion in water, the mechanics of lubricant transfer to metal surfaces, and the comparatively low lubricant potential available even under conditions thought to be ideal in the prior art, oil-in-water emulsion systems have been considered by the industry to be inadequate in providing lubrication and roll life improvement in the more demanding applications. A better alternative was thought to be found in the more expensive water miscible rolling lubricant of group (2). Alternatively, compositions assuming the properties of stable dispersions, as opposed to emulsions, offer alternatives to the more expensive water-miscible compositions.

Roll life improvements over conventional oil-in-water systems are recognized by the industry with the use of miscible lubricant systems which can at least partially justify the increase in lubrication cost. However, polar lubricants also have limited usefulness in high temperature applications because the polarity induced boundary film is destroyed by extreme heat. Despite the increased expense of operation, the industry trend has been toward the use of rolling lubricants that form miscible solutions or mixture in water which are thought to be normally better able to perform the vital role of lubrication because the industry has assumed that they are less subject to influences which inhibit lubrication of metal surfaces than oil-in-water emulsions.

Despite the industry trend toward the use of water-miscible compositions of type (2), there remains a need in the field for lubricant compositions which can provide the enhanced lubricity of the type (2) compositions, while at the same time providing the cost savings of oil based lubricants, and the essential ability to withstand the high temperature associated with more demanding milling operations. In addition, an ideal lubricant composition must also exhibit good lubricity, oxidation stability, antiwear and extreme pressure properties, antirust/anticorrosion properties, and possibly other characteristics dependent upon the particular application involved. The lubricant must also be essentially free from undesirable waxes. Waxes can build up in the reclassifier heads and cause restriction or complete blockage thereof. In either event, insufficient lubricant will be delivered to the point of lubrication and, in the case of bearings, can substantially shorten the life of the bearing.

The lubricant composition must also exhibit good wettability or spreadability on the surface(s) to which it is applied. One of the problems most frequently encountered with mist lubrication process for large bearings, such as those utilized on rolling and roll neck surfaces, is the lack of uniformity of lubricant distribution over bearing and roll neck surfaces. This lack of adequate lubricant film results in excessive localized wear and premature bearing failure. "Dry neck" or areas of insufficient lubrication on the roll neck are frequently observed disassembly of mist oil lubricated roll bearings. Lubricant compositions that result in all of the bearing and roll neck surfaces being uniformly coated with lubricant significantly prolong bearing life and reduce operating costs. Such compositions are said to possess desirable "plateout" characteristics.

The lubricant compositions of the present invention offer significant advantages over prior art lubricants in terms of cost, physical properties, operating characteristics, and, most importantly, the capacity for utilization in hot rolling steel mill applications where the high temperatures of operation of the mill apparatus would result in the degradation of conventional prior an compositions. These advantages will become apparent based upon the detailed description that follows.

DETAILED DESCRIPTION OF THE INVENTION

The present invention contemplates a hot mill lubricant composition capable of use in demanding hot steel rolling mill operations wherein the composition comprises a synthetic base carrier composition comprising a mixture of dimeric and polymeric esters formed between saturated and unsaturated fatty acids with up to 18 carbon atoms, and various alcohols and polyols, said composition having a molecular weight between 500 and 1000 daltons (da). In addition to providing superior lubrication compatible with mill operations at elevated temperatures, the composition of the present invention provides additional advantages such as superior breakout and plateout characteristics.

The hot mill lubricant composition of the present invention comprises from about 40 to about 70 weight percent of a synthetic base carrier composition. The base carrier comprises a mixture of dimeric and polymeric esters, and from about 30 to 60 weight percent of a natural oil, preferably soybean oil. Other natural oils could include corn, canola, sunflower, castor, rapeseed, olive, peanut, coconut and palm. These natural vegetable and plant oils are the preferred oil components since their naturally occurring fatty acids and triglycerides enhance high temperature lubrication. Furthermore, these oils are more easily treatable with standard waste treatment processes in contrast to refined petroleum hydrocarbons. In addition, the composition of the invention may include additional components primarily functioning as dispersants and surfactants. Preferably, the carrier component of the composition comprises about 45 to about 65 weight percent of a mixture of dimeric and polymeric esters formed between saturated and unsaturated fatty acids with up to 18 carbon atoms, and various alcohols and polyols, and the natural oil component comprises from about 35 to about 55 weight percent of the composition.

A preferred carrier component of the compositions of the present invention is Uniflex ® 103, obtainable from Union Camp Corporation, Chemical Products Division, Jacksonville, Fla. 32236. Uniflex 103 is a mixture of dimeric and polymeric acid esters obtained from the reaction of saturated and unsaturated fatty acids with up to 18 carbon atoms with mono- and polyhydroxy alcohols. A preferred alcohol is 2-ethylhexanol. Preferably, the base composition will have an apparent molecular weight of between 500 and 1000 Da. The exact composition of Uniflex 103 is registered under the New Jersey Worker and Community Right to Know Act with Trade Secret Registry Number 121307-5028. Typical properties of Uniflex 103 are listed below.

| PROPERTIES | |
|---|---|
| Properties | Value |
| acid value | 0.8 |
| viscosity | |
| 99° C. | 17 centistokes |
| 38° C. | 140 centistokes |
| 25° C. | 265 centistokes |
| −18° C. | 7,640 |
| −29° C. | 27,200 |
| viscosity | 649 (SUS @ 100° F.) |
| viscosity index | 142 |
| color (Gardner) | 8 |
| moisture (wgt %) | 0.05 |
| pour point | −47° C. |
| flash point | 310° C. |
| fire point | 349° C. |
| specific gravity | 0.912 (25° C.) |

In addition to the base carrier component described above, the compositions of the present invention also comprise a natural oil as a major component. This component provides additional lubricating properties to the compositions. Suitable natural oils are soybean oil, as well as palm, coconut, soybean, corn, canola, sunflower, castor, rapeseed, peanut, and olive oils, including blends. Suitable natural oils for the composition possess desirable properties including enhanced high temperature lubrication and compatibility with existing waste treatment processes.

The lubricant compositions of the present invention may comprise additional components such as about 0.01 to bout 0.5 weight percent polyethylene glycol monolaurate, obtainable as PEG 200ML TM from C.P. Hall, present in the composition as a dispersant. The most preferred polyethylene glycol monolaurate is a clear, light amber fluid in appearance with a maximum Gardner color of 5.0, maximum acid value of 5.0 and a specific gravity of 1.02. The composition may also comprise from about 0.5 to about 5.0 weight percent of a mixture of organic acids as a surfactant/dispersant. A preferred mixture of organic acids would comprise caprylic and captic acids and any blends thereof. The most preferred blend of organic acids is a blend of caprylic and capric acids commercially available from Proctor and Gamble, which is a light amber fluid in appearance, exhibits a preferred acid value of 365–375 and a preferred refracture index of 1.4260–1.4300. Preferably the dispersant mixture of organic acids comprises from about 0.5 to about 3.0 weight percent of the lubricant composition. Other suitable organic acids, and blends thereof, would include caproic, neodecanoic, pelargonic and lauric.

The lubricant composition of the present invention is comprised of a base carrier component that imparts characteristics to the lubricant that provide considerable advantages over the petroleum refined hydrocarbon oil lubricants of the prior art. The combination of the synthetic ester base carrier with a natural oil such as soybean oil provides superior lubricating properties when used in hot roll mill operations. More importantly, the lubricant compositions of the present invention are capable of use under some of the most demanding conditions associated with rollmilling operations, particularly temperatures in excess of the capacity of prior art lubricants to withstand. Not only is the component makeup of the composition of the invention critical to the advantageous application of the lubricant in hot mill rolling operations, those of skill in the art will recognize the ability of the compositions to maintain proper dispersion characteristics in the aqueous carrier is essential. These and other advantages will be apparent from the detailed Examples provided below.

The following examples are presented to describe preferred embodiments and utilities of the present invention and are not meant to limit the present invention unless otherwise stated in the claims appended hereto.

EXAMPLE 1

Preparation of Lubricant Composition

A composition of the present invention, was prepared as follows:

To a clean dry reaction vessel, 59 weight percent (as measured in final product) of Uniflex 103, and 39 weight percent soybean oil were added. The mixture was gradually warmed to 120° F. and maintained at that temperature for 15 minutes. Next, 0.025 weight percent of polyethylene glycol monolaurate, and 2 weight percent of a caprylic/capric acid mixture were added to the contents of the reaction vessel at 120° F. Contents of the vessel were maintained at 120° F. for fifteen minutes with constant agitation. Heat was removed from the reaction vessel and contents were allowed to cool. The resulting composition was filtered through a 50 mesh GAF bag prior to packaging for subsequent use.

The composition prepared according to the procedure above will be characterized by the following properties:

| | |
|---|---|
| Density: | 7.6–7.7 lbs/gal |
| Viscosity: | 365–415 (SUS at 100°F.) |
| Saponification Value: | 160.0–170.0 |
| Refractive index: | 1.480–1.482 (@ 25° C.) |
| Specific gravity: | 0.92 (@ 25° C.) |
| Appearance: | clear, amber fluid |
| Aroma: | mild fatty acid odor |

From hereforth, the composition described in Example 1 shall be referred to as the described invention, Composition A.

EXAMPLE 2

Laboratory Performance Evaluations

Laboratory performance evaluations are presented below to highlight the performance benefits of Composition A, the described invention from Example 1, for comparative purposes, performance data will be tested for Composition B. Composition B is a commercial hot rolling lubricant which is primarily based on petroleum refined hydrocarbon oil lubricants blended with a smaller portion of a natural vegetable oil. Physical properties are such for Composition B in that viscosity and saponification value are similar to those for the described invention, Composition A.

Falex Lubrication Evaluations (ASTM D3233-86)

ASTM D3233-86 was used as the test procedure for the lubrication testing done. This procedure is entitled "Standard Test method for Measurement of Extreme Pressure Properties of Fluid Lubricants (Falex pin and Vee Block Methods)." The basic test procedure consists of a rotating steel pin (journal) at 290±10 rpm against two stationary vee blocks (circular blocks with a concave inner surface) immersed in the lubricant sample. Load is applied (foot-pounds) via a ratchet mechanism and resulting torque values (generated from contact between blocks and pin in response to jaw loads) are recorded in pounds. Two test methods are specified under ASTM D3233-86 with Method B being the preferred method.

1. Method A: Load is applied continuously for one minute at 250 LbF and then ratchet is engaged allowing the load to increase continuously. Torque values were recorded at increments of 250 LbF starting at 250.
2. Method B: Load is applied for one minute at each of 250 LbF increments beginning at 250. Torque values were recorded at each 250 LbF increment.

Following criteria were used as indicators of failure (stopping test):

A. Falex pin breaks due to overheating and metal welding.

B. Torque values fail to increase with increasing load, torque values either remaining constant or dropping. This is an indication of extreme wear between blocks and pin.

C. Severe squealing from "metal to metal" contact between blocks and pin indicating a lack of lubricant film strength.

Dependent on which of the three scenarios occurred, torque values were recorded with load values and failure loads noted. Immediately following failure, final temperatures were recorded on lubricant samples in the test cup. Initial lubricant temperatures at start of all runs was 72°±1° F. In addition, observations were made and noted on the final lubricant condition following testing.

Composition A and B samples used for testing were freshly prepared in the laboratory and aged 24 hours prior to testing at ambient conditions. Number eight test pins (3135 steel, HRB 87–91, surface finish of 5–10 rms) were used with standard vee blocks. All pins and blocks were washed with hexane prior to use. Falex test unit was cleaned and wiped down with hexane following each test run. Unit was allowed to cool a minimum of ten minutes at ambient conditions prior to the start of the next run. Dispersions of Compositions A and B were made by placing hot mill lubricant and water portions (both by volume) in mini plastic Waring blender cups. A total of 200 ml of each test fluid was prepared. Dispersions were made at ambient temperature on the Waring blender, using the frape speed for two minutes. The dispersion was placed in the test cup and test run began within a minute from the completion of blender run (Falex test unit already setup). Dispersions were produced utilizing a lubricant concentration of 0.5% (5,000 ppm). Results are presented in Table I.

TABLE 1

| | Torque Values | | | |
|---|---|---|---|---|
| | Composition A | | Composition B | |
| Load | Run 1 | Run 2 | Run 1 | Run 2 |
| 250 | 4 | 3 | 3 | 4 |
| 500 | 10 | 11 | 7 | 8 |
| 750 | 14 | 13 | 12 | 10 |
| 1000 | 19 | 21 | 19 | 20 |
| 1250 | 22 | 23 | 21 | 24 |
| 1500 | 28 | 27 | 23 | * |
| 1750 | 31 | 33 | * | |
| 2000 | 36 | 35 | | |
| 2250 | 40 | 41 | | |
| 2500 | 48 | 47 | | |
| 2750 | * | * | | |

* = pin break

The results in Table I clearly indicate that Composition A provides better extreme pressure lubrication, based on high load levels, versus Composition B.

Falex Lubrication Evaluations (ASTM D2670-88)

ASTM D2670-88 was used as the test procedure when the lubrication testing done. This procedure is entitled "Standard Test Method For Measuring Wear Properties of Fluid Lubricants (Falex Pin and Vee Block Method)." Basic test procedure consists of a rotating steel pin (journal) at 290±10 rpm against two stationary vee blocks (circular blocks with a concave inner surface) immersed in the lubricant sample. Load is applied (foot-pounds) via a ratchet mechanism and the resulting torque values (generated from contact between blocks and pin in response to jaw loads) are recorded in pounds. Wear is determined and recorded as the number of teeth of the ratchet mechanism advanced to maintain a constant load during a prescribed test time interval.

Test procedures utilized for all testing is summarized below:

A. After pin and vee blocks are in place and surrounded by the test fluid, motor is turned on and ratchet engaged until load reaches 250 lbf.

B. Ratchet was disengaged and time started. Machine was run then for a five minute break-in period.

C. At end of five minute period, ratchet is reengaged and load increased to 900 lbf. When that load is reached, the ratchet was disengaged and preliminary torque value recorded. Timer was started and gear tooth number recorded (outer circumference) of ratchet wheel is numbered from 0 to 200.

D. Test is run for fifteen minutes. Whenever there was a drop of 25 lbf. to 875 lbf., load was run back to 900 lbf by engaging the ratchet mechanism. Fifteen minute test must be run with maintaining the load constant at 900 lbf. After fifteen minutes at the test load, load was reduced to 800 lbf. Ratchet was reengaged and load returned to 900 lbf. Ratchet was reengaged and load returned to 900 lbf. Gear tooth number from the final run was then recorded along with the final torque value.

E. Prior to each test run, Falex test pin was weighed after cleaning on a Mettler analytical scale to 1/10,000 of a gram. Following test run, pin was removed and again cleaned. Weight was recorded again and percent pin weight loss calculated.

Composition A and B samples used for testing were freshly prepared in the laboratory and aged 24 hours prior to testing at ambient conditions. Number eight test pins (3135 steel, HRB 87-91, surface finish of 5-10 rms) were used with standard vee blocks. All pins and blocks were washed with hexane prior to use. Falex test unit was cleaned and wiped down with a minimum of ten minutes at ambient conditions prior to the start of the next run. Dispersions of compositions A and B were made by placing hot mill lubricant and water portions (both by volume) in mini plastic Waring blender cups. A total of 200 ml of each test fluid was prepared. Dispersions were made at speed for two minutes. The dispersion was placed in the test cup and test run began within a minute from the completion of blender run (Falex test unit already setup).

Dispersions were prepared at 160° F. and maintained at 160°±5° F. during the test procedures. Dispersions were produced utilizing a lubricant concentration of 0.5% (5,000 ppm). Results are presented in Table II.

TABLE II

| | Composition A | | Composition B | |
|---|---|---|---|---|
| Parameter | Run 1 | Run 2 | Run 1 | Run 2 |
| Torque (start) | 7 | 7 | 4 | 5 |
| Torque (conclusion) | 19 | 24 | 21 | 22 |
| Number of Teeth | 10 | 6 | 12 | 11 |
| Percent pin weight loss | 0.0027% | 0.0019% | 0.0081% | 0.0093% |

Based on the results presented, Composition A dispersions exhibited less wear based upon lower teeth wear (lower number of teeth) and lower percent pin weight loss values in comparison to Composition B dispersions. Composition A offered better lubrication, based upon the wear properties evaluated, than Composition B.

Thermogravimetric Analyses (TGA)

Hot mill lubricants operate under high temperature conditions. Therefore, burn-off characteristics of these lubricants during pyrolysis are an important performance parameter. Thermogravimetry has been used as a successful research tool for evaluating this performance parameter. Thermogravimetry is a thermoanalytical technique where a known sample weight is continuously monitored under controlled heating and atmospheric conditions. Thermogravimetry (TG) will be used now to evaluate the burn-off and decomposition performance properties of Compositions A and B.

Both compositions were subjected to thermogravimetric analysis on the DuPont TGA 951 thermobalance. The thermobalance interfaced with the DuPont 9900 Thermal Analysis system. All experiments were conducted at a heating rate of twenty Celsius degrees per minute from ambient temperature to 780° Celsius under nitrogen purge. Sample sized ranged from 36.7530 to 49.7030 milligrams. Final percent TG residue determinations were made at 700° Celsius. Results are presented in Table III.

TABLE III

| Composition | Temperature Weight-Loss Range (°C.) | Maximum Peak Temp. (°C.) | Maximum Derivative Weight | Percent TG Residue |
|---|---|---|---|---|
| A | 210.0-500.0 | 451.20 | 1.66 | −0.02334 |
| B | 190.0-490.0 | 430.37 | 1.22 | 0.5556 |

The results presented clearly indicate that Composition A offers better high temperature stability (higher peak temperature and weight loss range), undergoes thermal decomposition at a faster rate (higher maximum derivative weight) and burns to a lower residue level (burns cleaner).

Cumulative Particle Size (Coulter Counter Analyses)

Particle size is extremely important for it is the determining factor in how hot mill lubricant dispersions plate out on work roll surfaces. Particle size will be a key indicator of the type of dispersion a hot mill lubricant actually will form. Smaller particle sizes would tend to be an indication of more stable forms of emulsions which will offer poor static separation. Larger particle sizes would be an indication of loose emulsions as mechanical dispersions where free oil separation would offer excellent static separation behavior.

Hot mill lubricant dispersions were made in deionized water on Osterizer at temperatures of 170°-18° F. Two hundred milliliter samples were prepared at dispersions of 500 ppm (0.1 gram lubricant) and 1000 ppm (0.2 gram lubricant) on Osterizer using frappe speed for 30 seconds. All dispersions were run on Coulter Counter Model TA11 freshly prepared.

Coulter Counter determines both the total populations and sizes of particles suspended in conductive liquids by forcing the suspension to flow through an aperture. Only particle sizes were determined in work presented in this example. Aperture with nominal diameter of 280 microns was used, effective for particle sizes from 5.6 to 108 microns.

An electrical current flows through the aperture between two electrodes immersed in the conductive fluid on opposite sides of the aperture. As dispersion particles pass through the electrical current, they momentarily produce a current pulse (which increases the resistance and reduces current). The series of pulses and the current change associated with it is proportional to the ratio of particle volume to volumetric aperture size. The series of pulses is electronically scaled and counted. Cumulative histogram plots are produced on X-Y recorder. Straight line graphs are drawn through the center points of the horizontal portions of the ascending plot. At the point where the straight line graph crosses the volumetric percentile, the corresponding particle size value is determined from the log scale on the Y axis. Results are presented in Table IV for 500 to 1000 ppm dispersions (Chicago tap water at 160° F.) for Compositions A and B.

TABLE IV

| Composition | Average Cumulative Particle Size (microns) 500 ppm | 1000 ppm |
|---|---|---|
| A | 16.3 | 16.0 |
| B | 16.2 | 16.8 |

Coulter Counter particle size analyses reveal that both composition form mechanical dispersions of virtually identical particle size in a range normally associated with excellent performance properties (plateout and breakout). Until now, we have seen that Composition A offers better lubrication and high temperature performance than Composition B which is based on petroleum hydrocarbon oils. The mechanical dispersions based on petroleum hydrocarbon oils though have always experienced excellent breakout and plateout characteristics in most field situations. Regarding these performance criteria, it is extremely important that Composition A exhibit equivalent or better performance than Composition B.

Breakout (Column Dispersion Studies)

Column dispersion studies were performed on aqueous dispersions of both Compositions A and B to quantify the rate and degree of lubricant breakout. Dispersions were made in Chicago tap water at temperatures of 160°14 170° F. in stainless steel beakers utilizing a PORTA-TEMP® unit as the source of heating and mixing. Two liters of dispersion were produced in a three liter beaker with the dispersion mixed for 30 minutes prior to the evaluations. Dispersions were made up containing 5000 ppm of lubricant. The dispersions were then placed in 2000 ml glass graduated cylinders and observations made on the percentage of clear aqueous layer versus time. Data is summarized in Table V with the values presented average values based on three runs.

TABLE V

| Time (minutes) | Percentage of Clear Aqueous Layer Composition A | Composition B |
|---|---|---|
| 0.5 | 3.00 | 4.00 |
| 1.0 | 5.00 | 5.00 |
| 1.5 | 10.00 | 9.00 |
| 2.0 | 12.00 | 11.00 |
| 5.0 | 22.00 | 18.00 |
| 10.0 | 36.00 | 29.00 |
| 15.0 | 51.50 | 53.00 |
| 20.0 | 90.50 | 62.00 |
| 25.0 | 100.00 | 94.00 |
| 30.0 | — | 96.00 |

The column dispersion studies reveal that Composition A dispersions exhibit lubricant breakout rates equivalent to the commercial Composition B. Both compositions exhibited lubricant layers on the surface which were uniform and homogenous in appearance with no signs of emulsification noted. The interface regions between lubricant and aqueous phases were sharp and distinct for both compositions.

Breakout (Ultrasonic Sedimentation Data)

Ultrasonic sedimentation is a static test for quantifying the degree of lubricant breakout. Dispersion samples are prepared as described in the column dispersion studies and then placed in sixteen ounce reservoirs. The dispersions are then allowed to age for 30 minutes at ambient conditions. The test consists of passing a concentrated ultrasonic signal through the reservoir (from bottom to top) at successive layers of the sample. Time of flight, the time necessary for the ultrasonic signal to pass from the signal source to the collection probe through the sample layer, is recorded in the micro seconds. Generally, as the time of flight value increases, the sample layer density increases. Densities can thus be charted and significant changes in those densities can be indicative of interfaces between fluids of different densities and the presence of various fluid layers. Ultrasonic sedimentation data for Compositions A and B is presented in Table VI.

TABLE VI

| Location | Time of Light (μs) Composition A | Composition B |
|---|---|---|
| Bottom | | |
| 4.05 | 35.062 | 35.101 |
| 4.20 | 35.062 | 35.095 |
| 4.35 | 35.065 | 35.101 |
| 4.50 | 35.064 | 35.104 |
| 4.65 | 35.061 | 35.099 |
| 4.80 | 35.062 | 35.104 |
| 4.95 | 35.057 | 35.103 |
| 5.10 | 35.059 | 35.109 |
| 5.25 | 35.060 | 35.102 |
| 5.40 | 35.058 | 35.109 |
| 5.55 | 35.060 | 35.104 |
| 5.70 | 35.062 | 35.104 |
| 5.85 | 35.058 | 35.109 |
| 6.00 | 35.058 | 35.107 |
| 6.15 | 35.059 | 35.103 |
| 6.30 | 35.064 | 35.110 |
| 6.45 | 35.061 | 35.107 |
| 6.60 | 35.070 | 35.103 |
| 6.75 | 35.077 | 35.103 |
| 6.90 | 35.076 | 35.093 |
| 7.05 | 35.071 | 35.103 |
| 7.20 | 35.348* | 35.244* |
| 7.35 | 35.321 | 35.223 |
| 7.50 | 35.373 | 35.246 |
| Top | | |

*Indicates lubricant phase - aqueous phase interface

The ultrasonic sedimentation data confirms the data from the column dispersion studies. Composition A exhibits similar breakout in aqueous dispersions to Composition B. Both lubricants exhibited interface regions between 7.05 and 7.20 cm regions.

Plateout Studies

Plateout studies were performed on 20% (20,000 ppm) dispersions of Compositions A and B in Chicago tap water. The dispersions were prepared as described in the column dispersion studies on the PORTA-TEMP unit at 160°–170° F. Hot rolled steel test strips (2.0 by 6.0 inches) were immersed in the active dispersion over various time increments. The strips were weighed before and after exposure to quantify the coating weight of lubricant present on the test strips. The test strips were purchased from ACT (Hillsdale, Mich.) and were a hot rolled steel substrate (General Motors 16–30). Results are presented in Table VII.

TABLE VII

| Time | Product Coating Weight (mg/ft$^2$) | |
|---|---|---|
| | Composition A | Composition B |
| 5 seconds | 234.31 | 207.08 |
| 15 seconds | 364.80 | 346.93 |
| 30 seconds | 403.91 | 462.18 |
| 45 seconds | 551.30 | 534.20 |
| 60 seconds | 571.60 | 548.61 |
| 2.0 minutes | 803.74 | 773.70 |
| 5.0 minutes | 1261.83 | 957.38 |
| 10.0 minutes | 1540.20 | 974.79 |
| 15.0 minutes | 1784.91 | 1067.40 |
| 20.0 minutes | 2273.91 | 1238.40 |
| 25.0 minutes | 2631.84 | 1426.80 |
| 30.0 minutes | 2911.63 | 1554.60 |

Composition A dispersions offered higher plateout coating weights than the dispersions for Composition B.

EXAMPLE 3

Field Evaluations

Trials of the hot mill lubricant composition of the present invention, prepared according to the procedure of Example 1, were performed at a steel mill rolling facility. The mill procedure in which the lubricant composition of the present invention was tested involved the production of steel fence posts. These fence posts are formed from the hardest steel stock material used at the facility.

The lubricant composition of the invention was used on the bottom finish pass component of the mill apparatus, the component that typically experiences wear failure most quickly. Thus, the wear life of this component generally determines the time between production shut downs necessitated by replacement of the component.

Two trials were performed using the lubricating composition of the present invention (Composition A). The first rial resulted in the production of 2750 fence posts over sixteen hours of continuous operation before wear failure forced shut down of the operation. The second trial resulted in the production of 2200 fence posts over 12 hours. An additional trial with a conventional lubricant (Composition B) resulted in the production of 1550 fence posts over 9 hours before wear failure of the apparatus. In comparison, recent wear history for the same apparatus with conventional prior art lubricants resulted in an average production between wear failure of 1254 fence posts, with a range of from 642 to 2155 fence posts.

Based on the results reported above, use of the lubricant compositions of the present invention provided a substantial improvement in lubrication over prior art lubricants.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

I claim:

1. A synthetic hot milled lubricant composition, the synthetic hot mill lubricant including: from about 40 to about 70 weight percent of an ester of an 18 carbon dimer acid distilled from tall oil and 2-ethylhexanol, the ester having an apparent molecular weight of from about 500 to about 1,000 daltons; from about 30 to about 60 weight percent of a natural oil lubricant; and a surfactant/dispersant comprising an effective amount of a mixture of caprylic acid and capric acid.

2. The lubricant composition of claim 1 wherein: the natural oil lubricant is soybean oil; the surfactant/dispersant includes from about 0.05 to about 5.0 weight percent of a mixture of caprylic and capric acids; and the lubricant composition further includes from about 0.01 to about 0.5 weight percent of polyethylene glycol monolaurate.

* * * * *